US006472802B1

(12) United States Patent
Choi et al.

(10) Patent No.: US 6,472,802 B1
(45) Date of Patent: Oct. 29, 2002

(54) TRIODE-TYPE FIELD EMISSION DEVICE HAVING FIELD EMITTER COMPOSED OF EMITTER TIPS WITH DIAMETER OF NANOMETERS AND METHOD FOR FABRICATING THE SAME

(75) Inventors: Sung-Yool Choi, Taejon (KR); Mun-Cheol Paek, Taejon (KR); Kyoung-Ik Cho, Taejon (KR); Jeen Hur, Taejon (KR); Gi-Pyung Han, Taejon (KR)

(73) Assignee: Electronics and Telecommunications Research Institute (KR)

( * ) Notice: Subject to any disclaimer, the term of this patent is extended or adjusted under 35 U.S.C. 154(b) by 0 days.

(21) Appl. No.: 09/471,892

(22) Filed: Dec. 23, 1999

(30) Foreign Application Priority Data

Jul. 26, 1999 (KR) ..... 99-30373

(51) Int. Cl.[7] ..... H01J 1/02

(52) U.S. Cl. ..... 313/309; 313/310; 313/336; 313/351

(58) Field of Search ..... 313/309, 310, 313/336, 351, 495; 428/402

(56) References Cited

U.S. PATENT DOCUMENTS

| | | | | |
|---|---|---|---|---|
| 5,578,901 A | | 11/1996 | Blanchet-Fincher et al. | 313/496 |
| 5,726,524 A | | 3/1998 | Debe | 313/309 |
| 5,760,536 A | * | 6/1998 | Susukida et al. | 313/311 |
| 5,872,422 A | * | 2/1999 | Xu et al. | 313/311 |
| 6,218,771 B1 | * | 4/2001 | Berishev et al. | 313/311 |
| 6,231,980 B1 | * | 5/2001 | Cohen et al. | 428/402 |

* cited by examiner

*Primary Examiner*—Sandra O'Shea
*Assistant Examiner*—Ronald E. DelGizzi
(74) *Attorney, Agent, or Firm*—Blakely Sokoloff Taylor & Zafman

(57) ABSTRACT

A triode-type field emission device includes an insulating substrate; a cathode formed on the insulating substrate; a field emitter aligned on the cathode, wherein the field emitter includes a plurality of emitter tips and each emitter tip has the diameter of nanometers; an insulating layer positioned around the field emitter for electrically isolating the field emitter; and a gate electrode formed on the insulating layer, wherein the gate electrode is closed to an upper portion of the field emitter. Therefore, the triode-type field emission device may be operable in a low voltage.

11 Claims, 9 Drawing Sheets

TRIODE-TYPE FIELD EMISSION DEVICE HAVING FIELD EMITTER COMPOSED OF EMITTER TIPS WITH DIAMETER OF NANOMETERS AND METHOD FOR FABRICATING THE SAME

FIELD OF THE INVENTION

The present invention relates to a field emission display; and, more particularly, to a triode-type field emission device having a field emitter composed of emitter tips with the diameter of nanometers and a method for fabricating the same.

DESCRIPTION OF THE PRIOR ART

Generally, in a field emission display a strong electric field is applied to a cathode of a field emitter to emit electrons, wherein the electrons excite phosphor materials deposited on an anode. The field emission display includes upper and lower panels. The upper panel includes the anode and the lower panel includes the cathode (the field emitter).

The conventional field emitter is composed of a plurality of emitter tips and fabricated by a metal or a semiconductor material such as silicon. There has been a problem that the conventional field emitter fabricated by the semiconductor material additionally needs a complicated process, e.g., an aging process to ensure the uniformity of an electron emission. Furthermore, when the electrons are emitted for a long time, the semiconductor field emitter may cause the degradation of the emitter tips.

As the field emitter, nanotubes made up of carbon or boron nitride and nanowires made up of gallium nitride or silicon carbide may be employed in a conventional diode-type field emission device. Since the nanotubes and the nanowires form the geometric structure having great aspect ratio, respectively, the nanotubes and the nanowires may be employed as the emitter tips having the diameter of nanometers. To fabricate the conventional diode-type field emission device having the carbon nanotubes, a print process and a chemical vapor deposition process have been employed, wherein the print process mixes grown carbon nanotubes with silver paste and adheres the carbon nanotubes to a substrate and the chemical vapor deposition process vertically deposits the nanotubes on the substrate. However, it is difficult for the print and chemical vapor deposition processes to be used to fabricate the field emission display. Also, there has been a problem that the conventional diode-type field emission device needs a high voltage of several hundred volts to several thousand volts to emit the electric field.

SUMMARY OF THE INVENTION

It is, therefore, an object of the present invention to provide a triode-type field emission device having a field emitter composed of emitter tips with the diameter of nanometers that may operable in a low voltage.

It is another object of the present invention to provide a triode-type field emission devices that may increase the number of emitter tips per unit area.

It is further another object of the present invention to provide a field emission display including triode-type field emission devices that respectively have a field emitter composed of emitter tips with the diameter of nanometers.

It is furthermore another object of the present invention to provide a method for fabricating a triode-type field emission device having a field emitter composed of emitter tips with the diameter of nanometers that may simply implement the triode-type field emission device in an effective manner.

In accordance with one embodiment of the present invention, there is provided a triode-type field emission device, comprising: an insulating substrate; a cathode formed on the insulating substrate; a field emitter aligned on the cathode, wherein the field emitter includes a plurality of emitter tips and each emitter tip has the diameter of nanometers; an insulating layer formed around the field emitter for electrically isolating the field emitter; and a gate electrode formed on the insulating layer, wherein the gate electrode is closed to an upper portion of the field emitter.

In accordance with another embodiment of the present invention, there is provided a field emission display, comprising: a plurality of triode-type field emission devices; and a fluorescent material excited by electrons emitted from the triode-type field emission devices, wherein each triode-type field emission device includes: an insulating substrate; a cathode formed on the insulating substrate; a field emitter aligned on the cathode, wherein the field emitter includes a plurality of emitter tips and each emitter tip has the diameter of nanometers; an insulating layer positioned around the field emitter for electrically isolating the field emitter; and a gate electrode formed on the insulating layer, wherein the gate electrode is closed to an upper portion of the field emitter.

In accordance with further another embodiment of the present invention, there is provided a method for fabricating a triode-type field emission device, comprising the steps of: (a) forming a cathode on an insulating substrate; (b) patterning a metal layer on the cathode; (c) selectively growing a field emitter on the metal layer, wherein the field emitter includes a plurality of emitter tips and each emitter tip has the diameter of nanometers; (d) forming an insulating layer on the field emitter; (e) forming a conductive layer of a gate electrode on the insulating layer; (f) selectively removing the conductive layer of the gate electrode; and (g) exposing the field emitter by etching the insulating layer.

In accordance with furthermore another embodiment of the present invention, there is provided a method for fabricating a triode-type field emission device, comprising the steps of: forming a gate electrode on a first substrate; forming an insulating layer to open a predetermined portion of the insulating layer and to cover the gate electrode; forming a metal isolating layer on the insulating layer; depositing a seed metal layer of a field emitter on the first substrate, wherein the field emitter includes a plurality of emitter tips and each emitter tip has the diameter of nanometers; growing the field emitter on the metal layer; removing the metal isolation layer; providing a cathode positioned on a second substrate; depositing the cathode on the resulting structure; removing the first substrate and the seed metal layer; and selectively etching the insulating layer to expose the sidewalls of the gate electrode.

BRIEF DESCRIPTION OF THE DRAWINGS

Other objects and aspects of the invention will become apparent from the following description of the embodiments with reference to the accompanying drawings, in which.

DETAILED DESCRIPTION OF THE INVENTION

Figure 1:
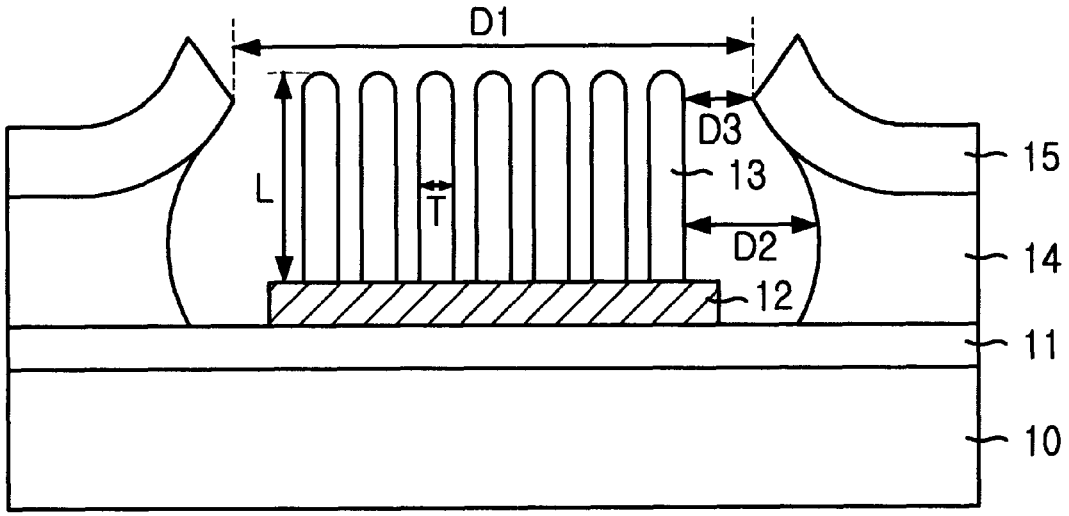
FIG. 1 is a cross-sectional view illustrating a triode-type field emission device in accordance with one embodiment of the present invention.

Referring to FIG. 1, a triode-type field emission device having a field emitter composed of emitter tips with the diameter of nanometers in accordance with the present invention. The triode-type field emission device includes an insulating substrate 10, a cathode 11, a metal layer 12, a field emitter 13, an emitter insulating layer 14 and a gate electrode 15.

The cathode 11 is formed on the insulating substrate 10. The metal layer 12 is finely patterned and formed on the cathode 11 to selectively grow the field emitter 13 thereon. The field emitter 13 includes a plurality of emitter tips, e.g., nanotubes, nanowires or a bundle of nanotubes and nanowires, which are formed on the metal layer only by using a growing process. The emitter tips have the diameter T of nanometers and the length L of approximately 1 $\mu$m. The triode-type field emission device can include further increased numbers of emitter tips per unit area of the metal layer. The field emitter 13 serves as an electron emission source. The emitter tips of the field emitter 13 are formed on the metal layer 12 in an orthogonal direction to the surface of the metal layer. In order to electrically isolate the field emitter 13 from another field emitter of another field emission device (not shown) and to support the gate electrode 15, the emitter insulating layer 14 is formed between the field emitter 13 and the other field emitter. That is, the insulating layer is formed around the field emitter 13. The distance D2 between the emitter insulating layer 14 and the field emitter 13 is several ten nanometers.

The metal layer 12 is electrically connected to the cathode 11 and the field emitter 13. The metal layer 12 is made up of a metal, e.g., Ni, Co or Fe and a compound metal. The metal layer 12 is finely patterned such that the field emitter 13 is selectively grown on the metal layer 12 more closely with a gate hole, thereby facilitating an electric field emission of the field emitter 13 in the low voltage. Particularly, since a material of the metal layer 12 becomes a seed of the nanotubes, the material of the metal layer 12 is very important. As the field emitter 13, the nanotubes made up of Carbon or Boron nitride and the nanowires made up of gallium nitride, silicon carbide or titanium may be employed in the triode-type field emission device. The nanotubes and the nanowires form the geometric structure of great aspect ratio and these facilitate the electric field emission in the low voltage, regardless of electric characteristics of the material of the field emitter 13. The gate electrode 15 is positioned closely with the field emitter 13 and the gate hole is formed on the field emitter 13. Accordingly, since the field emitter 13 is positioned more closely to the gate electrode 15, the field emitter 13 can emit the electric field in the low voltage. The electric field strength is disproportionate to the distance D3 between the gate electrode 15 and the field emitter 13. The distance D3 between the gate electrode 15 and the field emitter 13 in accordance with the present invention is preferably a quarter of the diameter D1 of the gate hole. The diameter D1 of the gate hole is approximately 1 $\mu$m and the distance D3 between the gate electrode 15 and the field emitter 13 is approximately 0.25 $\mu$m.

For the sake of convenience, although one triode-type field emission device is exemplarily described in FIG. 1, a field emission display employs the triode-type field emission device as described above. That is, the field emission display includes a plurality of triode-type field emission devices and a fluorescent material excited by electrons emitted from the triode-type field emission devices.

Referring to FIGS. 2A to 2H, there is shown a method for fabricating the triode-type field emission device shown in FIG. 1.

Figure 2A:
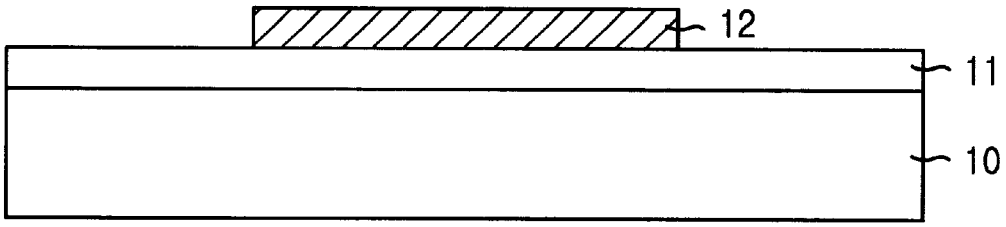
FIGS. 2A to 2H are cross-sectional views describing a method for fabricating the triode-type field emission device shown in FIG. 1

Referring to FIG. 2A, a cathode 11 and a metal layer 12 are in this order formed on an insulating substrate 10, wherein the metal layer 12 is finely patterned on the cathode 11 to thereby support a predetermined number of emitter tips shown in FIG. 1.

Figure 2B:
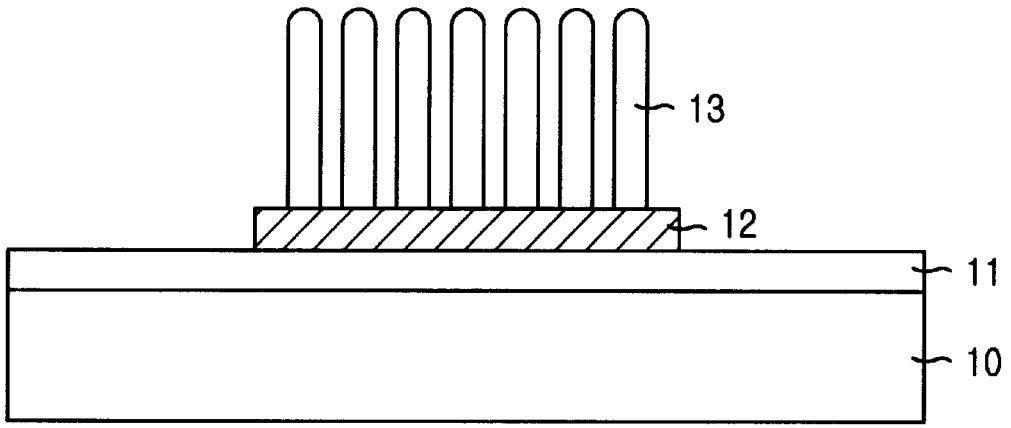

Referring to FIG. 2B, the field emitter tips, e.g., carbon nanotubes may be vertically grown on the metal layer 11 by using various techniques, e.g., chemical vapor deposition (CVD), DC arc discharge, laser evaporation, thermal pyrolysis and so on. On the other hand, gallium nitride, silicon carbide and titanium carbide of the nanowires may be grown in the pores of the nanotubes, employing mainly the carbon nanotubes as a template. When the nanotubes, porous silicon and zeolite having the pores are employed as the template of the nanowires and the gallium nitride is grown in the pores, the nanowires may be vertically grown on the metal layer 11.

Figure 2C:
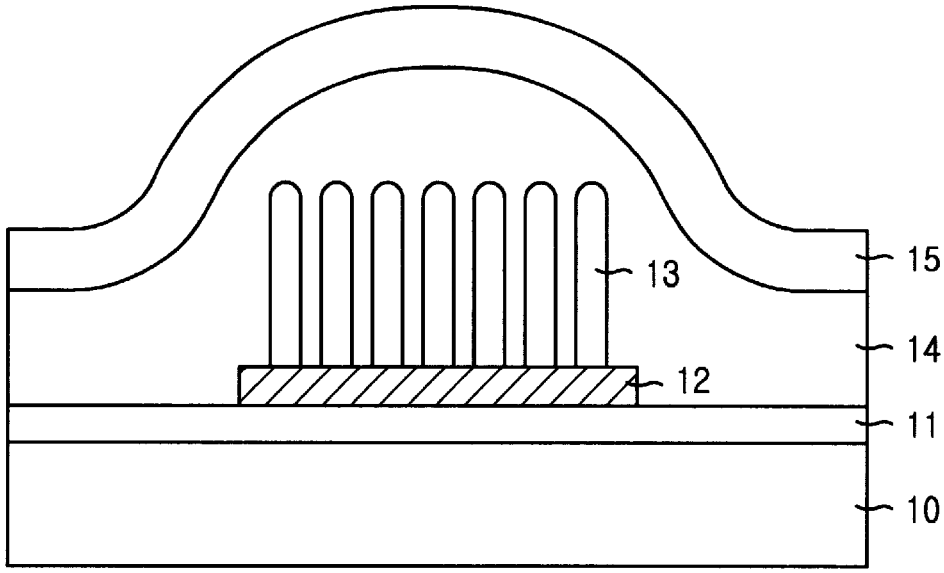

Referring to FIG. 2C, an insulating layer 14 of an oxide layer is deposited over all of the resulting structure shown in FIG. 2B. A gate electrode 15 of a conductive layer is then formed on the insulating layer 14.

Figure 2D:
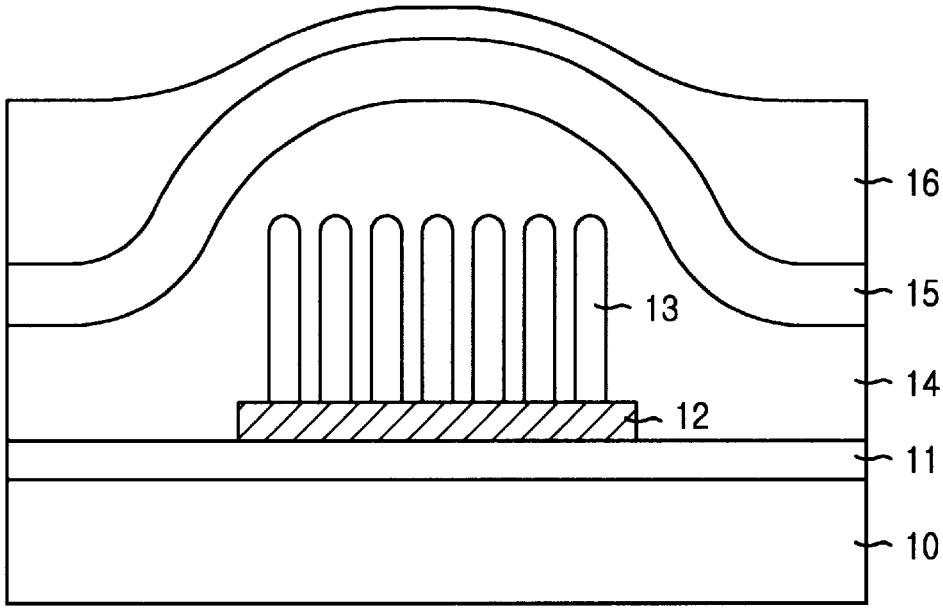

Referring to FIG. 2D, after the formation of the gate electrode 15, a photoresist layer or a spin-on-glass 16 for planarization is coated on the gate electrode 15.

Figure 2E:
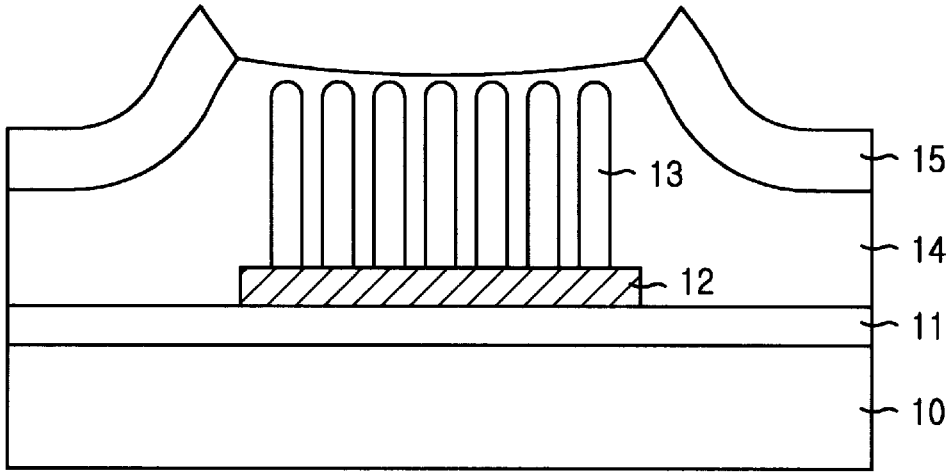

Referring to FIG. 2E, the photoresist layer or the spin-on-glass 16, the gate electrode 15 and the insulating layer 14 are etched by the etchback and then a gate hole is formed in the gate electrode 15. At this time, the diameter, shape and position of the gate hole is controlled by an etch rate of the photoresist layer or the spin-on-glass 16, the gate electrode 15 and the insulating layer 14.

Figure 2F:
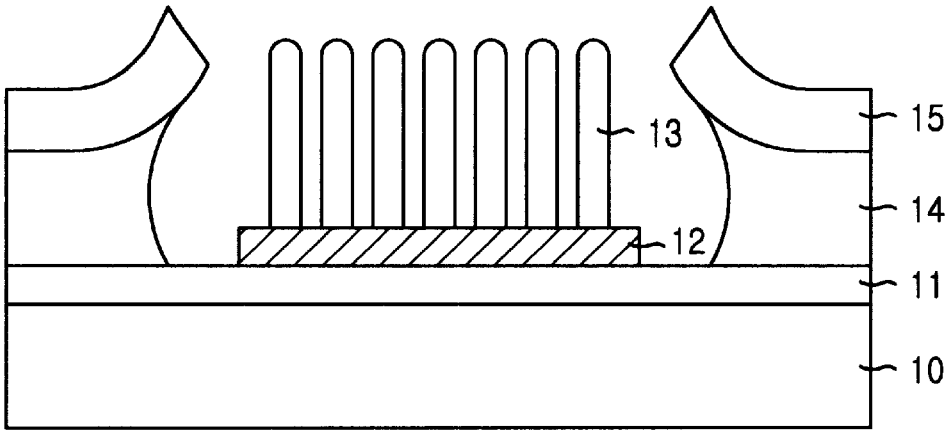

Referring to FIG. 2F, the insulating layer 14 is etched by isotropic etching and then the triode-type field emission device is complete.

Figure 2G:
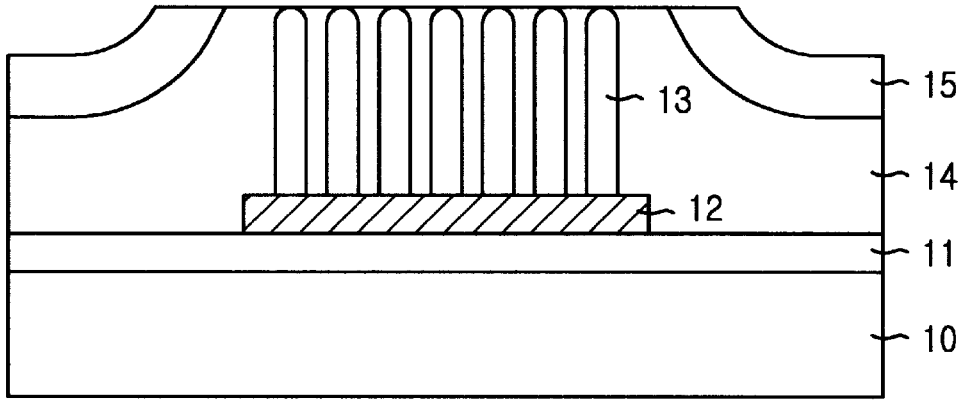
Figure 2H:
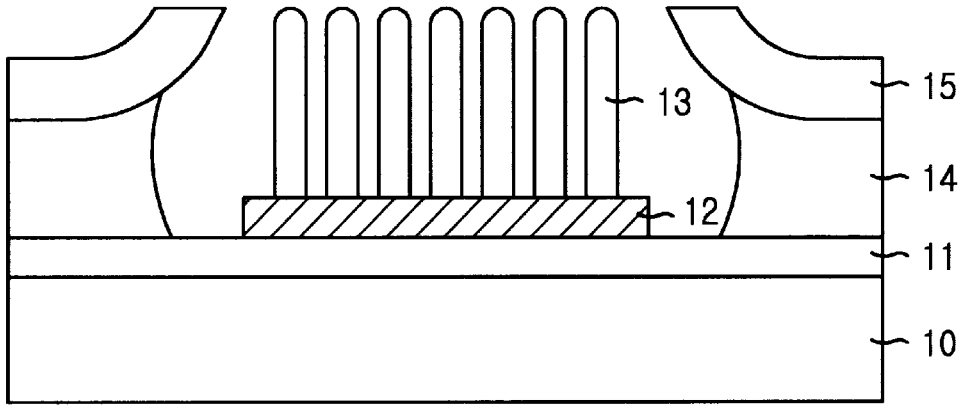

Also, referring to FIGS. 2G and 2H, it will be understood that the gate electrode 15 is etched by using chemical mechanical polishing and a self-aligned gate hole is formed on the field emitter 13.

Referring to FIG. 2G, after the formation of the gate electrode 15 shown in FIG. 2C, the insulating layer 14 and the gate electrode 15 are polished by using the chemical mechanical polishing such that the field emitter 13 is aligned with the gate electrode 15.

Referring to FIG. 2H, the insulating layer 14 is etched by using isotropic etching and then the triode-type field emission device is complete. When the insulating layer 14 is etched by using the isotropic etching, the insulating layer 14 deposited between the emitter tips is etched but the emitter tips have not the influence of the isotropic etching owing to the chemical safety of the emitters 13.

Figure 3:
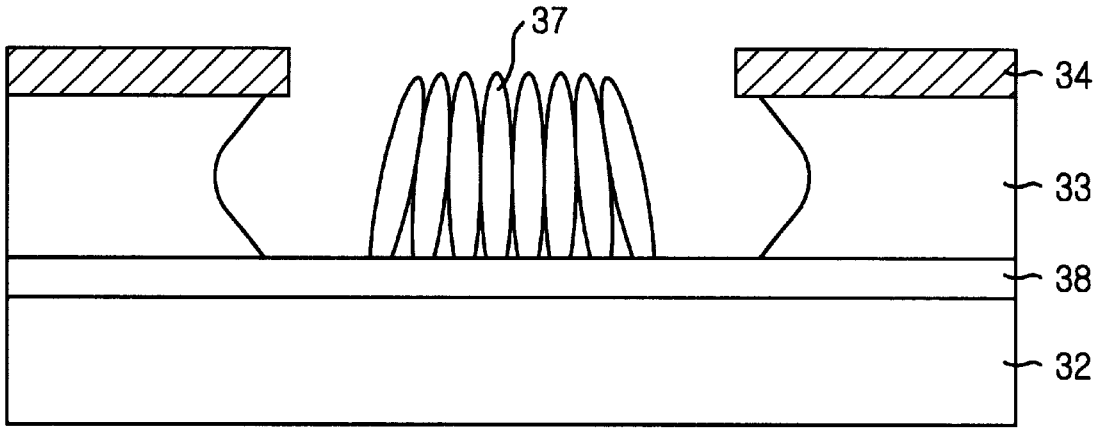
FIG. 3 is a cross-sectional view showing a triode-type field emission device in accordance with another embodiment of the present invention.

FIG. 3 is a cross-sectional view illustrating a triode-type field emission device having a field emitter in accordance with another embodiment of the present invention.

Referring to FIG. 3, a field emitter 37 is in the constant direction formed on a cathode 38, wherein the cathode 38 is positioned on an insulating substrate 32. An insulating layer 33 electrically isolates a field emitter from other field emitter (not shown).

FIGS. 4A to 4G are cross-sectional views illustrating a method for fabricating the triode-type field emission device having a field emitter shown in FIG. 3.

Figure 4A:
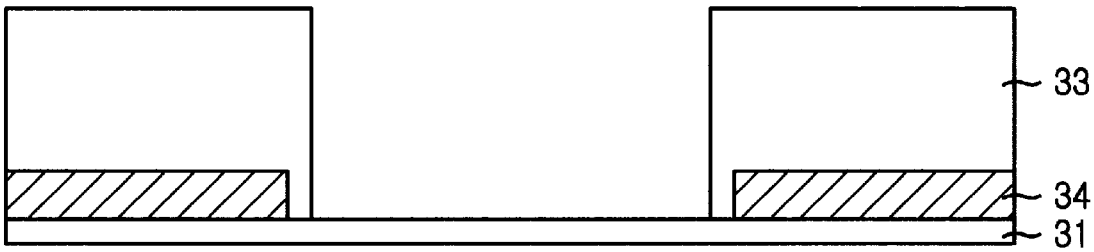
FIGS. 4A to 4G are cross-sectional views depicting a method for fabricating the triode-type field emission device shown in FIG. 3.

Referring to FIG. 4A, a gate electrode 34 of a metal layer finely patterned is formed on a first substrate 31. An insulating layer 33 is formed on the resulting structure to have an opening in the gate electrode 34.

Figure 4B:
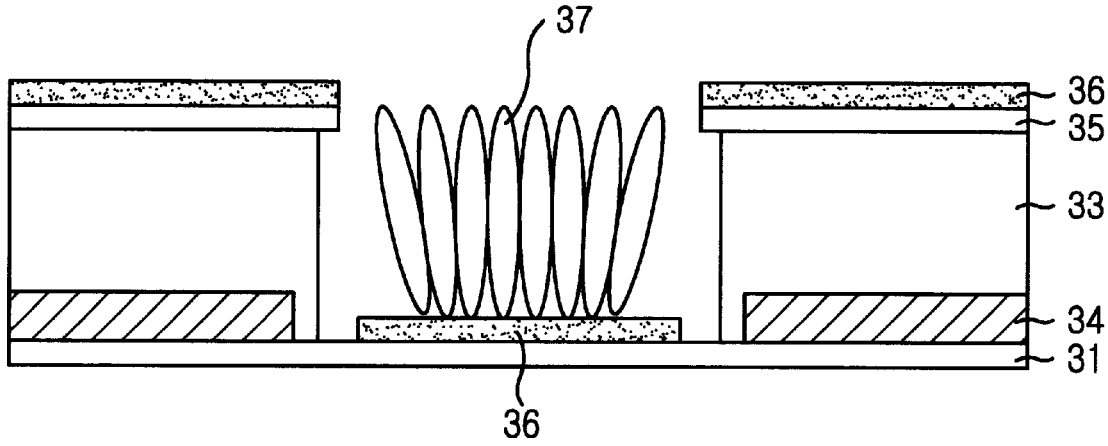

Referring to FIG. 4B, a metal isolating layer 35 is thinly formed on the insulating layer 33 and seed metal layers 36 are deposited on the resulting structure by using physical deposition. At this time, the seed metal layers 36 are formed on the metal isolating layer 35 and on the opening of the insulating layer 33. The seed metal layers 36 are separated from each other. After the formation of the seed metal layers 36, a field emitter 37 is formed on the seed metal layer 36 of the opening by using chemical vapor deposition (CVD), DC arc discharge, laser evaporation, thermal pyrolysis and so on, wherein the field emitter 37 includes a plurality of emitter tips and each emitter tip has the diameter of nanometers.

Figure 4C:
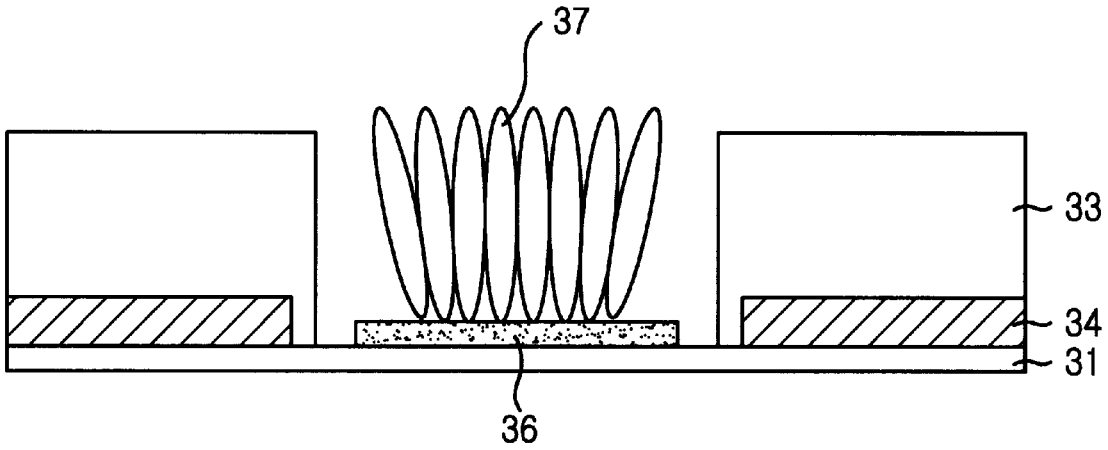

Referring to FIG. 4C, the metal isolating layer 35 is removed.

Figure 4D:
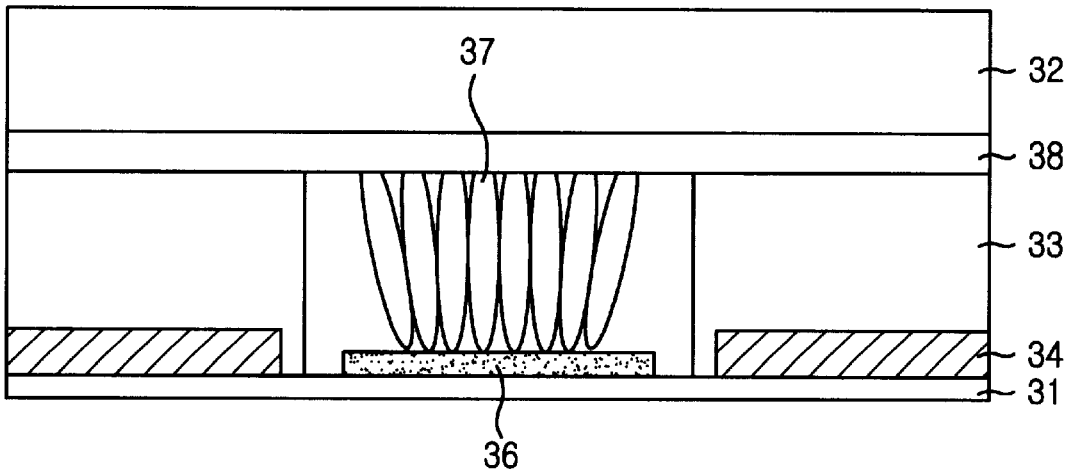

Referring to FIG. 4D, a cathode 38 is deposited on the resulting structure such that the cathode 38 is in contact with the field emitter 37, wherein the cathode is positioned on a second substrate 32.

Figure 4E:
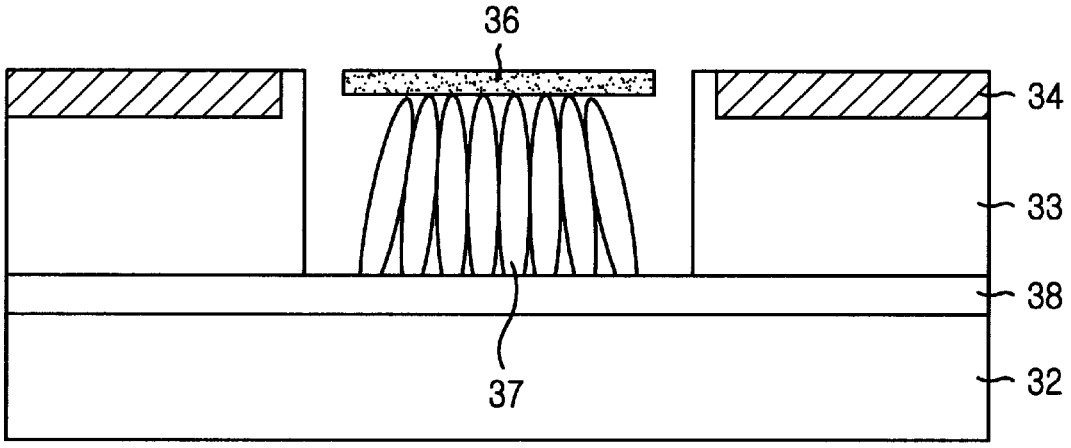

Referring to FIG. 4E, the first substrate 31 is removed.

Figure 4F:
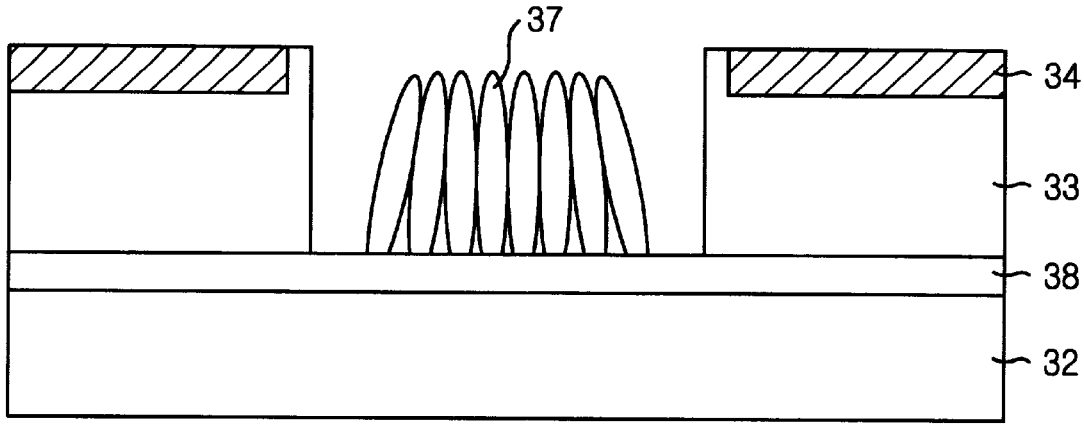

Referring to FIG. 4F, the seed metal layer 36 positioned beneath the field emitter 37 is removed.

Figure 4G:
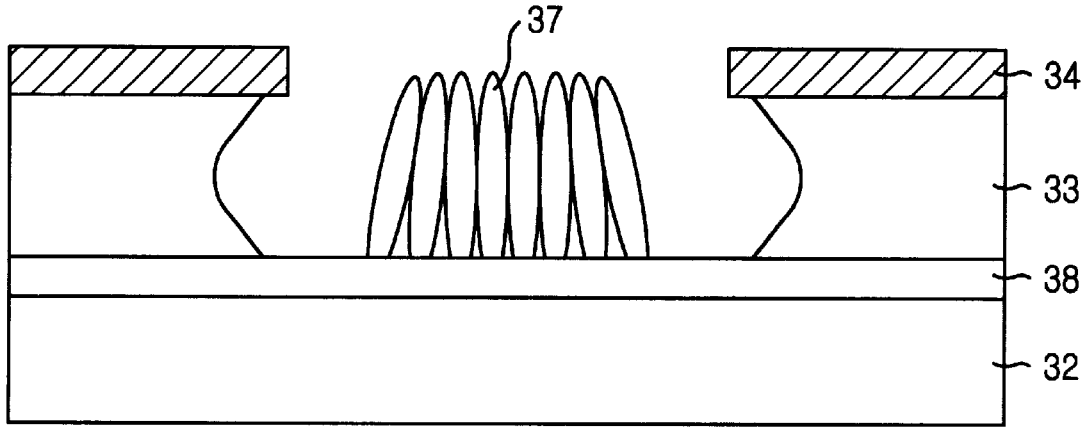

Referring to FIG. 4G, the insulating layer 33 is selectively etched to expose the sidewalls of the gate electrode 34 and then the triode-type field emission device is complete.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A triode-type field emission device, comprising:

an insulating substrate;

a cathode formed on the insulating substrate;

a field emitter aligned on the cathode, wherein the field emitter includes a plurality of emitter tips and each emitter tip has the diameter of nanometers;

an insulating layer positioned around the field emitter for electrically isolating the field emitter; and a gate electrode formed on the insulating layer, wherein the gate electrode is adjacent to an upper portion of the field emitter, wherein the gate electrode has a gate hole formed on the field emitter and the distance between the gate electrode and the field emitter is a quarter of the diameter of the gate hole.

2. The triode-type field emission device as recited in claim 1, wherein the triode-type field emission device further includes:

a seed metal layer formed between the field emitter and the cathode.

3. The triode-type field emission device as recited in claim 1, wherein the diameter of the gate hole is approximately 1 $\mu$m and the distance between the gate electrode and the field emitter is approximately 0.25 $\mu$m.

4. The triode-type field emission device as recited in claim 1, wherein each emitter tip is a nanotube.

5. The triode-type field emission device as recited in claim 1, wherein each emitter tip is a nanowire.

6. The triode-type field emission device as recited in claim 4, wherein the nanotube is made up of carbon.

7. The triode-type field emission device as recited in claim 4, wherein the nanotube is made up of boron nitride.

8. The triode-type field emission device as recited in claim 5, wherein the nanowire is made up of gallium nitride.

9. The triode-type field emission device as recited in claim 5, wherein the nanowire is made up of silicon carbide.

10. The triode-type field emission device as recited in claim 5, wherein the nanowire is made up of titanium carbide.

11. A field emission display, comprising:

a plurality of triode-type field emission devices; and a fluorescent material excited by electrons emitted from the triode-type field emission devices, wherein each triode-type field emission device includes:

an insulating substrate;

a cathode formed on the insulating substrate;

a field emitter aligned on the cathode, wherein the field emitter includes a plurality of emitter tips and each emitter tip has the diameter of nanometers;

an insulating layer positioned between the field emitter and other field emitter for electrically isolating the field emitter from the other field emitter; and a gate electrode formed on the insulating layer, wherein the gate electrode is adjacent to an upper portion of the field emitter, wherein the gate electrode has a gate hole formed on the field emitter and the distance between the gate electrode and the field emitter is a quarter of the diameter of the gate hole.

* * * * *